United States Patent [19]

Johnson

[11] Patent Number: 4,509,483

[45] Date of Patent: Apr. 9, 1985

[54] FUEL INJECTION APPARATUS AND SYSTEM

[75] Inventor: Kalin S. Johnson, Northville, Mich.

[73] Assignee: Colt Industries Operating Corp, New York, N.Y.

[21] Appl. No.: 573,336

[22] Filed: Jan. 24, 1984

[51] Int. Cl.[3] ..... F02M 32/00; F02M 7/24; F02B 75/18

[52] U.S. Cl. ..... 123/432; 123/438; 123/440; 123/457

[58] Field of Search ..... 123/438, 437, 457, 489, 123/440, 432; 261/50 R, 69

[56] References Cited

U.S. PATENT DOCUMENTS

| | | | |
|---|---|---|---|
| 3,981,284 | 9/1976 | Gospodar | 123/438 |
| 4,217,314 | 8/1980 | Dysarz | 123/438 |
| 4,246,875 | 1/1981 | Bier et al. | 123/438 |
| 4,294,282 | 10/1981 | McCabe et al. | 123/438 |
| 4,323,041 | 4/1982 | Endo et al. | 123/432 |
| 4,381,738 | 5/1983 | Shaffer | 123/432 |
| 4,406,266 | 9/1983 | Kiesling | 123/440 |

*Primary Examiner*—Raymond A. Nelli

*Attorney, Agent, or Firm*—Walter Potoroka, Sr.

[57] ABSTRACT

A fuel metering apparatus is shown as having a throttle body with an induction passage therethrough and a throttle valve for controlling flow of induction air through the induction passage, first and second passages are provided with the first passage having an inlet at one end and communicating at its other end with a source of fuel, the second passage has an inlet at one end and communicates with the flow of induction air thereby serving as a metered fuel discharge nozzle, fuel at a regulated superatmospheric pressure is delivered as through a movable tubular member and discharged through an open end thereof in a manner whereby such discharged fuel is alternately directed toward the inlet of the first passage and toward the inlet of the second passage, a magnetic field is cyclically produced as to thereby cause movement of the movable tubular member as to thereby cause such discharged fuel to be alternately directed to the inlets of the first and second passages, the portion of the fuel directed to the inlet of the second passage being that used in forming the fuel-air mixtures supplied to the engine.

14 Claims, 4 Drawing Figures

FUEL INJECTION APPARATUS AND SYSTEM

FIELD OF INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

For example, the prior art in trying to meet the standards for $NO_x$ emissions has employed a system of exhaust gas recirculation whereby at least a portion of the exhaust gas in reintroduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixtures are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits.

The prior art, in view of such anticipated requirements, with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel) the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of the associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

Further, various prior art structures have experienced problems in being able to supply metered fuel, at either a proper rate or in a proper manner, as to provide for a smooth engine and/or vehicle acceleration when such is demanded.

The prior art has proposed many specific forms of fuel metering arrangements employable in either or both of such overall systems generally classified as fuel "injection systems" or "carbureting systems".

Regardless of the overall system in which employed, such prior art fuel metering arrangements can be grouped into two general catagories. The first of such catagories comprises those metering arrangements wherein a valving member is partly or wholly received within a cooperating metering orifice and axially movable relative to such orifice in order to thereby vary the effective flow area of the metering orifice and thereby variably control the rate of metered fuel flow through the orifice for a given pressure differential thereacross. The valving element 69 and/or 72 and cooperating orifice 20 of U.S. Pat. No. 4,217,314 as well as valving member 140 and orifice 144 of U.S. Pat. No. 4,246,875 may be considered as generally typifying such first catagory of prior art metering arrangements.

The second of such catagories comprises a valving arrangement whereby a valve member is oscillatingly or intermittently moved as to alternatingly close and open an associated metering orifice or passage.

In such a prior art metering arrangement the ratio of the cycle time during which the valve member is positioned as to have the associated metering orifice or passage open compared to the cycle time during which the valve member is positioned as to have the associated metering orifice or passage closed determines the rate of metered fuel flow through such metering orifice or passage. The valving member 227 and cooperating orifice or passage 171 of U.S. Pat. No. 4,294,282 as well as the valving member 74 and cooperating orifice or passage 72 of U.S. Pat. No. 4,406,266 may be considered as generally typifying such second catagory of prior art metering arrangements.

In said first catagory, the dimensions of both the valve member and cooperating orifice must be held to very close tolerances and there are additional problems of maintaining concentricity not only in the respective valve member and cooperating orifice but also as between the two even during axial movement of the valve member. Further, as vehicular engines become smaller the rates of metered fuel flow to the engine also become lesser and the problems of close tolerances, concentricity and alignment of and between the valve member and cooperating orifice are exacerbated because the effective flow or metering area is reduced and what might have been previously acceptable as a dimensional tolerance or variation becomes, precentage-wise, to great to tolerate in a metering area of considerably reduced magnitude. Such reduced areas are also highly susceptible to becoming either partly or completely clogged by foreign particles entrained in the fuel.

In said second catagory, the valve member may be oscillated (to and from a closed position), for example, at a rate of 80 cycles per second. (Some prior art systems employ a slower rate while others employ even a faster rate.) Such prior art metering arrangements depend on achieving a total termination of fuel flow during the time that the valve member is moved to a closed position against the cooperating fuel metering orifice or passage. However, this is difficult to achieve because of the tendency of the valving member to bounce back away from its seat or because of the wear experienced by the valve member during normal operation with such wear producing fuel leakage paths past the valve member. Attempts to solve such problems as by the use of, for example, a ball valve member and cooperating generally conical seat have not, thus far, produced appreciable benefits.

Accordingly, the invention as disclosed and described is directed, primarily to the solution of such and other related and attendant problems of the prior art.

SUMMARY OF THE INVENTION

According to one aspect of the invention, a fuel injection apparatus and system for a combustion engine comprises throttle body means, induction passage means formed through said throttle body means, throttle valve means for controlling the flow of induction air through said induction passage means, an associated source of fuel, metered fuel discharge nozzle means for discharging metered fuel into said flow of induction air through said induction passage means, said metered fuel discharge nozzle means comprising first fuel inlet means, fuel return passage means for operative communication with said associated source of fuel, said fuel return passage means comprising second fuel inlet means, fuel discharge orifice means, means for providing a supply of fuel under regulated superatmospheric pressure to said fuel discharge orifice means as to be discharged therethrough, and means responsive to indicia of engine operation for causing a first portion of said fuel as is discharged from said discharge orifice means to flow into said second inlet means and through said fuel return passage means and causing a second portion of said fuel as is discharged from said discharge orifice means to flow into said first inlet means and be discharged by said metered fuel discharge nozzle means into said flow of induction air, said second portion of said fuel as is discharged into said flow of induction air determining the rate of metered fuel flow being supplied to said engine, said means responsive to indicia of engine operation being effective to vary the relative proportion of said first portion compared to said second portion as to thereby vary the rate of said metered fuel flow in accordance with engine operating conditions.

A general objective of the invention is to provide a fuel injection apparatus wherein the actual fuel metering function is performed by what may be considered as a "valveless" metering means. That is, a metering means which uses neither a valve partly or wholly received within a cooperating metering orifice nor a valve which intermittently opens and closes an associated metering orifice or passage. In the main, the invention accomplishes this by supplying fuel (at a regulated superatmospheric pressure) to and through a discharge orifice at a substantially constant rate of fuel flow which exceeds the maximum rate of fuel flow that the engine would require during its range of engine operation. The fuel thusly discharged from the said discharge orifice is cyclically (of varying cycle time and/or duration) directed as to first and second inlet orifices of respective first and second passages. The second inlet orifice and second passage lead back to, generally, the source of the supply of fuel while the first inlet orifice and first passage lead to the engine induction passage means. In such an arrangement, the pressure regulated fuel is being constantly discharged from the said discharge orifice at substantially a constant rate of flow. The metering function is achieved by alternating the direction of such constant rate of flow to and from said first inlet orifice and to and from said second inlet orifice. In any particular cycle, the longer the flow of such constant rate of fuel flow is directed to said first inlet orifice, the greater the rate of metered fuel flow to the engine induction passage means. That portion of the constantly discharged fuel flow which is cyclically directed to said second inlet orifice is merely returned as to the vehicular fuel supply means as, for example, the usual fuel tank.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted.

DETAILED DESCRIPTION OF THE PREFERRED EMBODIMENT

Figure 1:
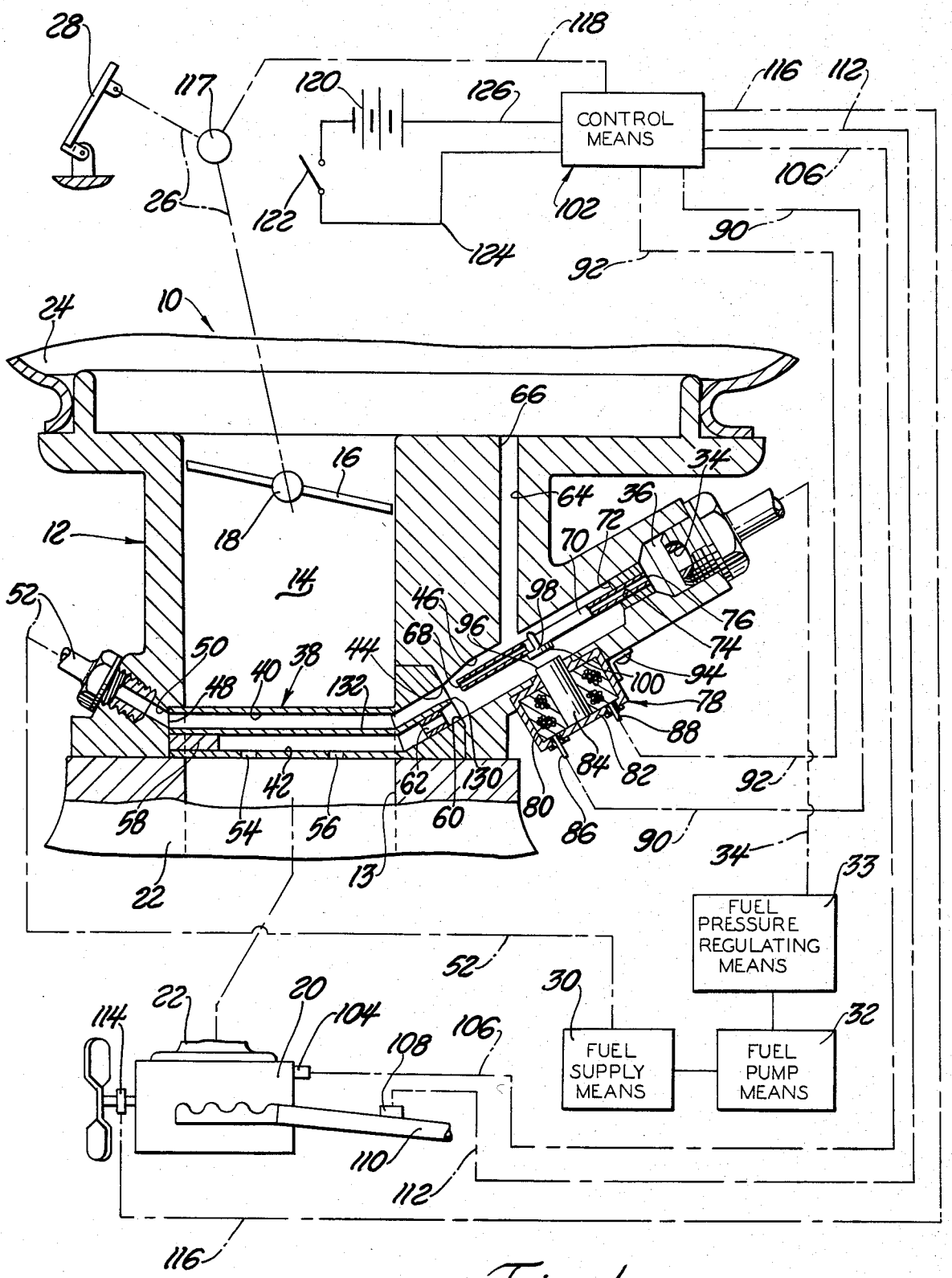
FIG. 1 illustrates in cross-section one form of the fuel injection apparatus and system employing teachings of the invention.

Referring now in greater detail to the drawings, FIG. 1 illustrates fuel injection apparatus 10 and system comprised as of induction body or housing means 12 having induction passage means 14 wherein a throttle valve 16 is situated and carried as by a rotatable throttle shaft 18 for rotation therewith thereby variably restricting the flow of air through the induction passage means 14 and into the engine 20 as via associated engine intake manifold means 22. If desired suitable air cleaner means, fragmentarily depicted at 24, may be provided as to generally emcompass the inlet of induction passage means 14. The throttle valve means 16 may be suitably operatively connected as through related linkage and motion transmitting means 26 to the operator positioned throttle control means which, as generally depicted, may be the operator foot-operated throttle pedal or lever 28 as usually provided in automotive vehicles.

A source of fuel as, for example, a vehicular gasoline tank 30, supplies fuel to associated fuel pumping means 32 which, in turn, pressurizes the fuel and supplies such to associated fuel pressure regulating means 33. The pressure regulated but unmetered fuel flows as via conduit means 34 to chamber or conduit means 36. Even though in the preferred embodiment the fuel pressure regulating means 33 comprises throttling type regulating means, the invention could be practiced employing a bypass type fuel pressure regulating means.

In the preferred embodiment, a generally bar-like or multi-tubular body 38 extends generally transversely of and through the induction passage means 14. In the preferred form, the body 38 comprises a first passage or conduit means 40 and a second passage or conduit means 42 disposed generally below and downstream (relative to the direction of flow through induction passage means 14) of conduit means 40.

Passage or conduit means 40 comprises fuel return passage means and, at one end, has an inlet 44 which communicates with a passage or chamber 46. Further, conduit means 40, at its other end 48, communicates with a source of fuel, as for example, 30, via conduit means 50, formed in throttle body 12, and associated coupled conduit means 52.

Passage or conduit means 42 comprises fuel discharge nozzle means and is provided with a plurality of nozzle discharge passages or orifices 54 and 56 communicating generally between passage 42 and the flow of induction air passing through the induction passage means 14. The fuel discharge nozzle means is closed at one end, as at 58, and, at its other end, is provided with an inlet 60 which communicates with passage or chamber 46. Further, in the preferred embodiment, the fuel discharge nozzle means passage 42 is provided with critical flow orifice or restriction means 62 which provides for sonic flow therethrough for much of the engine operating range. Such restriction means 62 is situated upstream of nozzle discharge passages 54 and 56.

A conduit 64 having one end 66 communicating as with a source of ambient air, within the air cleaner means 24, has its other end communicating with passage or chamber 46 at a location as to be upstream of inlet 60.

The unmetered fuel may be provided to chamber 36, at a regulated pressure of, for example, 10.0 p.s.i., from where it is delivered to a discharge orifice 68 which, in the embodiment of FIG. 1, is at the free or cantilevered end of a tubular member 70 having its other end carried as by a wall portion 72 which also sealingly separates chambers 36 and 46. Tubular member 70 comprises a conduit 74 which has an inlet end 76, communicating with chamber 36, and an outlet end defined by said discharge orifice means 68. Although the tubular member 70 may be formed of any suitable material, in the preferred embodiment the member 70 is formed of stainless steel.

An electromagnet assembly 78 is illustrated as comprising a field coil or winding 80 contained as within suitable housing means 82 and surrounding associated pole-piece means 84. The winding 80 is illustrated as having electrical terminals 86 and 88 which are, in turn, electrically connected to conductor means 90 and 92, respectively. The entire assembly 78 may be operatively secured to throttle body means 12 by any suitable means as, for example, by a bracket 94 and associated fastener means.

In the preferred embodiment, when the electromagnet assembly 78 is secured to body means 12, the face 96 of pole-piece means 84 is exposed to chamber or passage 46. Further, an armature means 98 is suitably secured to and carried by tubular member 70 as to have the armature face 100 juxtaposed to pole-piece face 96. The tubular member 70 is selected as to have an inherent bending spring rate and the location of the electromagnet means 78 and the armature 98, along tubular member 70, are such so that upon energization of the field coil means 80, the armature 98 is drawn towards and preferably contacts the pole-piece face 96. In so doing the armature 98 causes the tubular member 70 to bend, against its inherent resilient resistance, resulting in the discharge orifice means 68 being directed toward inlet 60. Upon de-energization of the electromagnetic motor means 78, armature 98 is released and the inherent spring rate of tubular member 70 returns the discharge orifice means 68 to the position generally depicted whereby it is directed toward inlet 44.

The electrical conductors 90 and 92 may be electrically connected to related control means 102. In the preferred embodiment, the fuel metering valving means, comprising discharge orifice means 68 and inlets 44 and 60, is caused to function or operate in a duty cycle type manner. This is accomplished by the intermitten energization of winding 80 thereby causing, during such energization, armature 98 to move in a direction toward pole-piece face 96 and the simultaneous movement of discharge orifice means 68 to be directed toward inlet 60. Generally, as should be apparent, with such a duty cycle type of metering or directing fuel flow, the effective rate of fuel flow directed toward inlet 60 can be variably and controllably determined by controlling the frequency and/or duration of the energization of coil means 80.

The control means 102 may comprise, for example, suitable electronic logic type control and power outlet means effective to receive one or more parameter type input signals and in response thereto produce related outputs. As general examples, engine temperature responsive transducer means 104 may provide a signal via transmission means 106 to control means 102 indicative of engine temperature; sensor means 108 may sense the relative oxygen content of the engine exhaust gases (as within engine exhaust conduit means 110) and provide a signal indicative thereof via transmission means 112 to control means 102; engine speed responsive transducer means 114 may provide a signal indicative of engine speed via transmission means 116 to control means 102 while throttle valve 16 position sensor 117 may provide a signal as via transmission means 118 to control means 102.

A source of electrical potential 120 along with related switch means 122 may be electrically connected as by conductor means 124 and 126 to control means 102.

OPERATION OF INVENTION

Generally, in the embodiment disclosed in FIG. 1, fuel under pressure is supplied as by fuel pump means 32 to the fuel pressure regulating means 33 which regulates the pressure of the fuel to, for example, 10.0 p.s.i. Such fuel, at regulated pressure but as yet unmetered, is then supplied to chamber or passage 36 as via conduit means 34.

The pressure regulated fuel then enters inlet 76 of conduit 74, of tubular member 70, and flows therethrough being discharged by discharge orifice means 68 into either or both inlets 44 and 60. The total rate of fuel flow discharged from discharge orifice means 68 is established as to be, preferably, in excess of the maximum rate of fuel flow which the associated engine 20 could require under maximum load conditions. However, the rate of metered fuel flow will be dependent upon the relative percentage of time, during an arbitrary cycle time or elapsed time, that discharge orifice means 68 is directed toward nozzle inlet 60 as compared to the percentage of time that discharge orifice means 68 is directed toward the inlet 44 of fuel return conduit or passage means 40.

This, in turn, is dependent on the output to coil or winding 80 from control means 102 which, in turn, is dependent on the various parameter signals received by the control means 102. For example, if the oxygen sensor and transducer means 108 senses the need of a further fuel enrichment in fuel-air mixture being supplied to the engine and transmits a signal reflective thereof to the control means 102, the control means 102, in turn, will require that the discharge orifice means 68 be directed a greater percentage of time toward the nozzle inlet 60 as to provide the necessary increased rate of metered fuel flow. Accordingly, it will be understood that given any selected parameters and/or indicia of engine operation and/or ambient conditions, the control means 102 will respond to the signals generated thereby by providing appropriate energization and de-energization of coil means 80 (causing corresponding movement of armature 98 and discharge orifice means 68) thereby achieving the then required metered rate of fuel flow to the nozzle inlet 60 and engine 20.

In the preferred embodiment, conduit means 64 supplies a portion of the air needed to sustain idle engine operation when the throttle valve means 16 is closed. As can be seen, a flow circuit is described by inlet 66 of conduit 64, conduit 64, chamber or passage 46, inlet 60, restriction means 62, passage 42 and nozzle discharge passages or orifices 54 and 56 and engine intake manifold induction passage means 13; such, in the preferred embodiment of the invention, provides a portion of the air flow to the engine 20 required for idle engine operation. The balance of the air flow required for idle is supplied through the induction passage 14. The restriction means 62 is of a size as to result in the air flow therethrough being critical or sonic flow during idle engine operation. The fuel which is directed from and by discharge orifice means 68 and effectively injected into inlet 60 mixes with the air flowing into inlet 60 and as such fuel and air flows through restriction means 62, the emulsion of fuel and air becomes accelerated to sonic velocity. The fuel within such fuel-air-emulsion becomes atomized as it undergoes acceleration to sonic velocity and subsequent expansion as in the downstream portion of nozzle conduit or passage means 42. The atomized fuel-air-emulsion then passes through passage means 42 and is discharged therefrom through discharge port means 54 and 56 into passage means 13 of engine 20. In the preferred embodiment of the invention, the restriction means 62 not only provides for sonic flow therethrough during the idle engine operation but also provides for sonic flow therethrough during conditions of engine operation other than idle and, preferably, over much of the entire range of engine operation.

When further engine power is required, throttle valve means 16 is opened to an appropriate degree and the various related parameter sensing means create input signals to control means 102 resulting in discharge orifice means 68 being directed a correspondingly increased proportion of time toward inlet 60 thereby providing the necessary increase in the rate of metered fuel flow through nozzle passage means 40 and ultimately to the engine 20.

As should be apparent, suitable temperature responsive means may be provided in order to slightly open throttle valve means 16 during cold engine idle operation in order to thereby assist in sustaining cold engine operation and preclude rough engine operation.

In the preferred embodiment the wall portion 132 generally separating inlets 44 and 60 is provided with a relatively sharp or knife-edge end 130. Such sharp edge 130 serves to further enhance the metering accuracy of the fuel being metered as the discharge orifice means 68 alternately is directed toward the inlet 44 and inlet 60.

Any portion of the total available fuel flow through conduit 74 which is not metered into metered fuel discharge nozzle inlet 60 is, of course, directed to inlet 44 of fuel return passage means 40 from where it is returned to an associated source of fuel as at, for example, 30.

EMBODIMENT OF FIG. 2

Figure 2:
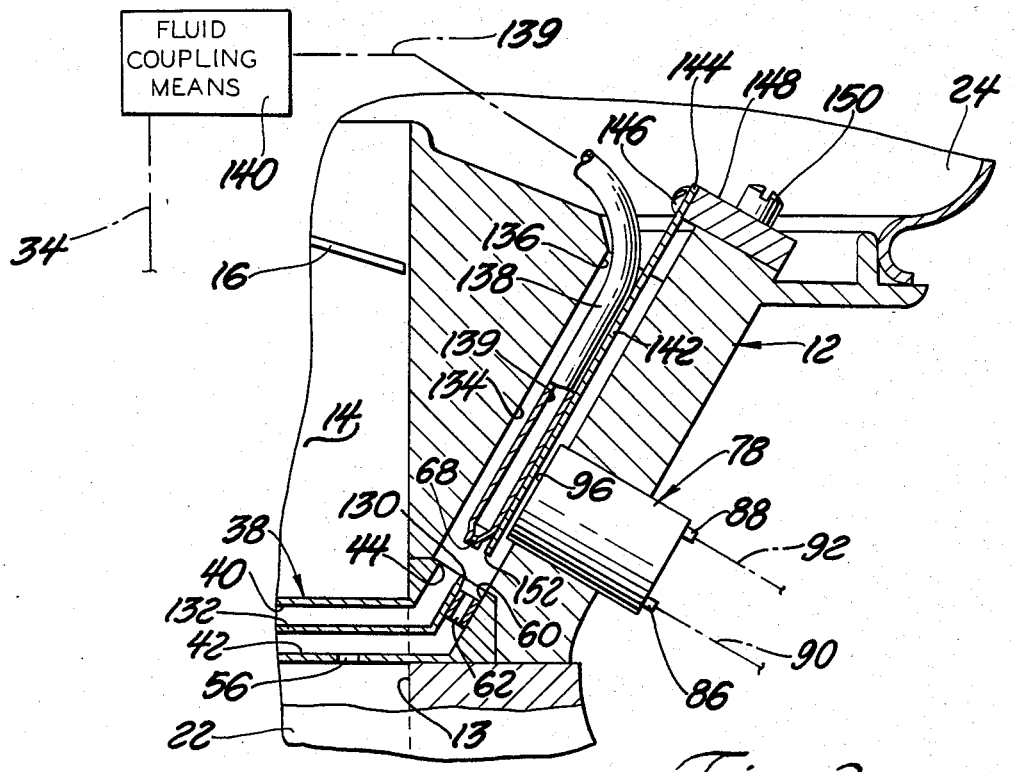
FIG. 2 illustrates, in fragmentary cross-section, another form of fuel injection apparatus and system employing teachings of the invention.

FIG. 2 illustrates, fragmentarily, a modification or second embodiment of the invention. Only so much of the overall structure is illustrated as is considered sufficient to understand such embodiment and how it differs from that of FIG. 1 along with the operation thereof. Generally, all elements in FIG. 2 which are like or functionally similar to those of FIG. 1 are identified with like reference numbers. Further, it may be assumed that the remaining elements of FIG. 1, and which are not shown in FIG. 2, including those depicted in schematic and/or diagrammatic form, are operatively connected to the structure of FIG. 2 in the same manner as depicted in FIG. 1.

Referring in greater detail to FIG. 2, it can be seen that a chamber or passage 134 is somewhat similar to chamber 46 of FIG. 1 except that passage 134 has its upper end 136 (as viewed in FIG. 2) open to communication with ambient air as within the air cleaner assembly 24 thereby providing for the air flow which, in FIG. 1, was supplied via conduit means 64.

The discharge orifice means 68 is carried by and defined at the free end of a flexible tubular member 138 which has its opposite end suitably connected, as through suitable fluid coupling means 140, to the outlet of fuel pressure regulating means 33 (FIG. 1) via conduit means 34 so that the pressure regulated but unmetered fuel supplied by regulating means 33 flows through conduit 139 of tubular member 138 and ultimately out of discharge orifice means 68. The flexible tubing or tubular member 138 is, in turn, suitably secured, over a portion of its axial length, to a leaf spring 142 as by an adhesive or other suitable fastening means.

The leaf spring means 142 is secured at one end 144, as by fastener means 146, to a mounting block 148 which, in turn, is secured as by fastener means 150 to carburetor body means 12. Consequently, the leaf spring 142 is cantilevered having its main body portion and free end 152 resiliently movable toward and away from the electromagnet pole-piece face 96.

Whenever control means 102 (FIG. 1) causes pulsed energization of electromagnetic means 78, the resulting field draws the cantilevered portion of leaf spring 142 towards pole-piece face 96 thereby, to the same degree, deflecting the direction of that portion of tubular member 138 secured thereto and the direction of discharge orifice means 68 so that the fuel being discharged by discharge orifice means 68 is directed toward inlet 60 of the metered fuel discharge nozzle passage means 42.

When control means 102 (FIG. 1) causes de-energization of electromagnetic motor means 78, the armature or leaf spring 142 is magnetically released and it resiliently returns to the position generally depicted in FIG. 2 whereby the fuel being discharged via discharge orifice means 68 is directed toward inlet 44 of fuel return passage means 40.

The overall operation of the apparatus of FIG. 2 is that as already described with reference to FIG. 1 and the selective positioning of discharge orifice means 68, relative to edge 130, may be that as also described with reference to FIG. 1.

EMBODIMENT OF FIG. 3

Figure 3:
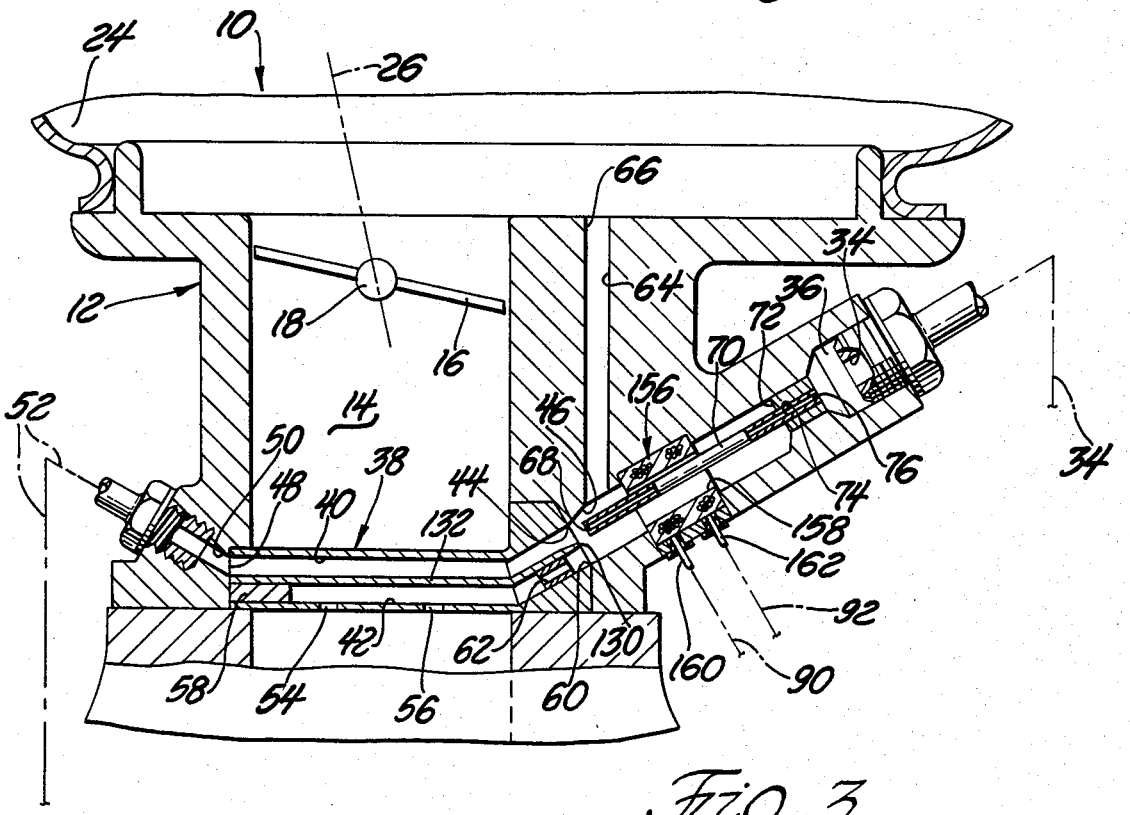
FIG. 3 illustrates, in cross-section, still another form of fuel injection apparatus and system employing teachings of the invention.

FIG. 3 illustrates a further modification or third embodiment of the invention. Generally, all elements in FIG. 3 which are like or functionally similar to those of FIG. 1 are identified with like reference numbers. Further, it may be assumed that the remaining cooperating elements of FIG. 1, and not shown in FIG. 3, including those depicted in schematic and/or diagrammatic form, are operatively connected to the structure of FIG. 3 in the same manner as depicted in FIG. 1.

Referring in greater detail to FIG. 3, it can be seen that in the embodiment of FIG. 3, the electromagnetic means 78 of FIG. 1 has been replaced by an electrical field winding or coil 156 having a generally axially extending clearance passageway 158 through which the resiliently deflectable tubular member 70 extends. The field generating winding 156 has electrical terminals 160 and 162 respectively electrically connected to conductor means 90 and 92 leading to control means 102 (FIG. 1).

As generally depicted in FIG. 3, when the tubular member 70, comprised of magnetically responsive material, is in its null position it assumes a position eccentric to the axis of clearance passageway 158. Therefore, when field winding 156 is energized, by control means 102, the field generated generally within the clearance passageway 158 causes the resiliently deflectable tube 70 to move in a manner as to seek a magnetically neutral or balanced position within the clearance passageway 158. The tubular member 70 does this by seeking a position more nearly centrally of or more nearly axially of passageway 158 and as a consequence undergoes a resilient bending resulting in discharge orifice means 68 being directed toward inlet 60 of metered fuel discharge nozzle passage means 42.

When control means 102 (FIG. 1) causes de-energization of field winding 156, the attendant magnetic field collapses and the resilience of tubular member 70 returns the tubular member 70 to the position generally depicted in FIG. 3 whereby the fuel being discharged via discharge orifice means 68 is directed toward inlet 44 of fuel return passage means 40.

The overall operation of the apparatus of FIG. 3 is that as already described with reference to FIG. 1.

In each of the embodiments of FIGS. 1, 2 and 3, the return of fuel from conduit means 40 is depicted as being made to the fuel supply means 30. It is apparent that such excess fuel being returned may just as well be returned to the inlet of pump means 32.

EMBODIMENT OF FIG. 4

Figure 4:
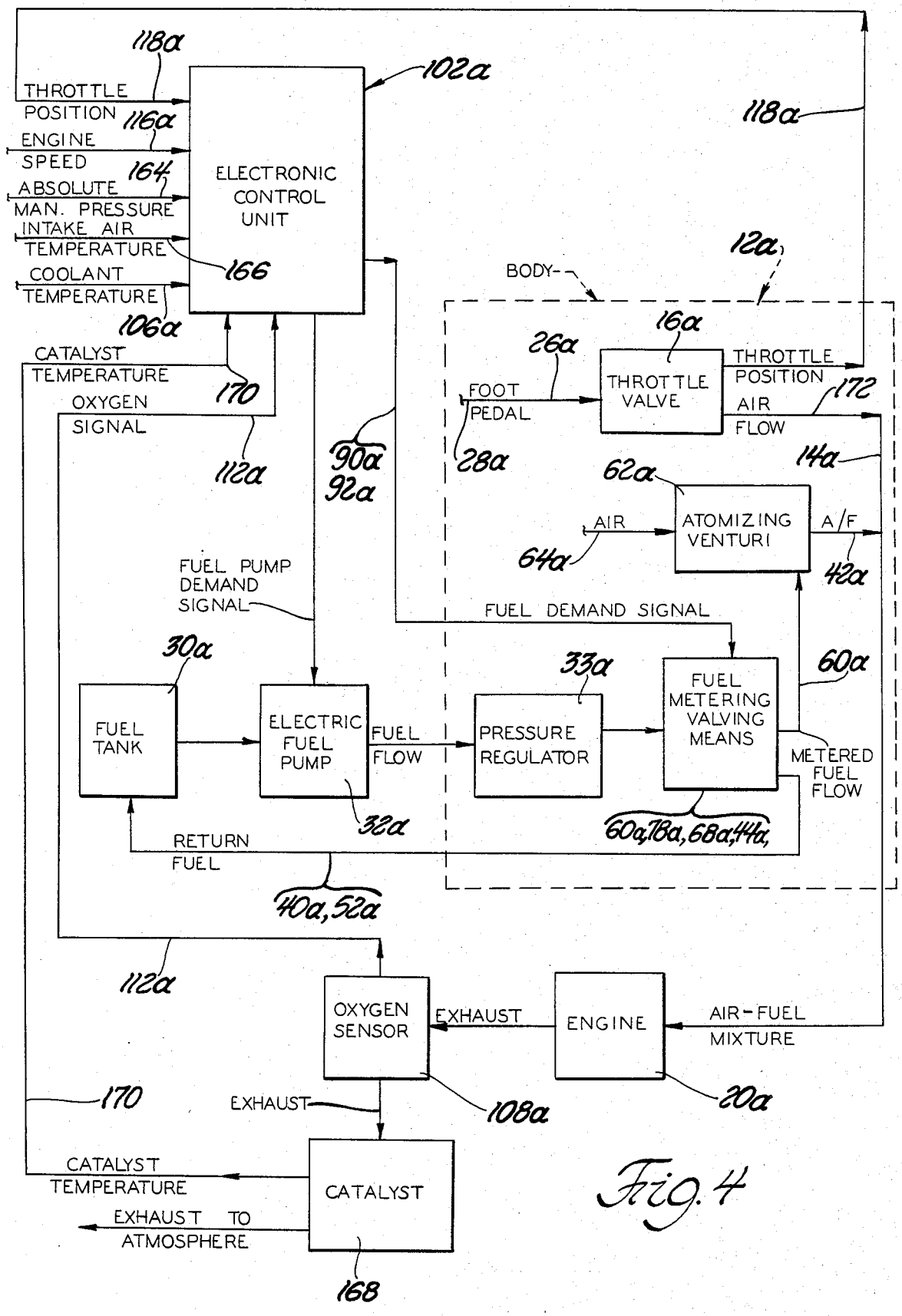
FIG. 4 is a block diagram of an entire fuel metering system as may be applied to or employed in combination with the fuel injection apparatus of either FIGS. 1, 2 or 3.

FIG. 4 illustrates in general block diagram the invention of any of FIGS. 1, 2 or 3 along with other contemplated operating parameter and indicia sensing means for creating related inputs to the control means which, as generally identified in FIG. 4, may be an electronic control unit. For ease of reference, elements in FIG. 4 which correspond to those of any of FIGS. 1, 2 or 3 are identified with like reference numbers provided with a suffix "a".

As generally depicted in FIG. 4 the electronic control or logic means 102*a* is illustrated as receiving input signals, as through suitable transducer means, reflective and indicative of various engine operating parameters and indicia of engine operation. For example, it is contemplated that the electronic logic or control means 102*a* would receive, as inputs, signals of the position of the throttle valve means 16*a* as via transducer or transmission means 118*a*; the magnitude of the engine speeds as by transducer or transmission means 116*a*; the magnitude of the absolute pressure within the engine intake manifold 22 as by transducer or transmission means 164; the temperature of the air at the inlet of the induction system as by transducer or transmission means 166; the magnitude of the engine 20*a* coolant system temperature as via transducer or transmission means 106*a*; the magnitude of the engine exhaust catalyst 168 temperature as by transducer or transmission means 170; and the percentage of oxygen (or other monitored constituents) in the engine exhaust as by transducer or transmission means 112*a*.

In considering both FIGS. 1 and 4 it can be seen that the electronic control means 102*a*, upon receiving the various input signals, creates a first output signal as along conductor means 90*a* and 92*a* thereby energizing fuel metering valving means 78*a*, 68*a*, 44*a* and 60*a*. If the operator should open throttle valve means 16*a*, as through pedal 28*a* and linkage or transmission means 26*a*, the new position thereof is conveyed to the control means 102*a* and an additional rate of air flow 172 is permitted into the induction passage means 14*a* as to become commingled with the fuel-air emulsion being discharged by the nozzle means 42, 54 and 56.

In any event, the fuel-air mixture is introduced into the engine 20*a* (as via intake manifold means 22) and upon being ignited and performing its work is emitted as exhaust. An oxygen or other gas sensor, or the like, 108*a* monitors the engine exhaust gases and in accordance therewith creates an output signal via transducer means 112*a* to indicate whether the exhaust gases are overly rich, in terms of fuel, too lean in terms of fuel, or exactly the proper ratio. The electronic control means, depending upon the nature of the signal received from the gas sensor 108*a*, produces an output signal as via conductor means 90*a* and 92*a* for either continuing the same duty cycle of fuel metering valve means 78*a*, 68*a*, 44*a* and 60*a* or altering such as to obtain a corrected duty cycle and corresponding altered rate of metered fuel flow. Generally, each of such input signals (varying either singly or collectively) to the electronic control means (except such as will be noted to the contrary) will, in turn, cause the electronic control means 102*a* to produce an appropriate signal to the fuel metering valve assembly 78*a*, 68*a*, 44*a* and 60*a*.

As is also best seen in FIG. 4, in the preferred embodiment, a fuel supply or tank 30*a* supplies fuel to the inlet of a fuel pump 32*a* (which may be electrically driven and actually be physically located within the fuel tank means 30*a*) which supplies unmetered fuel to suitable pressure regulator means 33*a* which supplies pressure regulated fuel to fuel metering valving assembly 78*a*, 68*a*, 44*a*, and 60*a*. Return conduit means 40*a*, 52*a* serves to return excess fuel as to the inlet of pump means 32*a* or, as depicted, to the fuel tank means 30*a*.

In practicing the invention, it is contemplated that certain fuel metering functions may be or will be performed in an open loop manner as a fuel schedule which, in turn, is a function of one or more input signals to the control means 102*a*. For example, it is contemplated that acceleration fuel could be supplied and metered by the fuel metering valving assembly 68*a*, 78*a* as a function of the position of throttle valve means 16*a* and the rate of change of position of such throttle valve means 16*a* while the engine cranking or starting fuel and cold engine operation fuel metering schedule would be a function of engine temperature, engine speed and intake manifold pressure. Further, it is contemplated that open loop scheduling of metered fuel flow would be or could be employed during catalytic converter warm-up and for maximum engine power as at wide open throttle conditions as well as being employed during and under any other conditions considered necessary or desirable.

Although only a preferred embodiment and selected modifications of the invention have been disclosed and described, it is apparent that other embodiments and modifications of the invention are possible within the scope of the appended claims.

What is claimed is:

1. Fuel injection apparatus and system for a combustion engine, comprising throttle body means, induction passage means formed through said throttle body means, throttle valve means for controlling the flow of induction air through said induction passage means, an associated source of fuel, metered fuel discharge nozzle means for discharging metered fuel into said flow of induction air through said induction passage means, said metered fuel discharge nozzle means comprising first fuel inlet means, fuel return passage means for operative communication with said associated source of fuel, said fuel return passage means comprising second fuel inlet means, fuel discharge orifice means, means for providing a supply of fuel under regulated superatmospheric pressure to said fuel discharge orifice means as to be discharged therethrough, and means responsive to indicia of engine operation for causing a first portion of said fuel as is discharged from said discharge orifice means to flow into said second inlet means and through said fuel return passage means and causing a second portion of said fuel as is discharged from said discharge orifice means to flow into said first inlet means and be discharged by said metered fuel discharge nozzle means into said flow of induction air, said second portion of said fuel as is discharged into said flow of induction air determining the rate of metered fuel flow being supplied to said engine, said means responsive to indicia of engine operation being effective to vary the relative proportion of said first portion compared to said second portion as to thereby vary the rate of said metered fuel flow in accordance with engine operating conditions.

2. Fuel injection apparatus according to claim 1 wherein said means responsive to indicia of engine operation comprises magnetic field generating means.

3. Fuel injection apparatus according to claim 1 wherein said discharge orifice means is movable relative to said first and second inlet means.

4. Fuel injection apparatus according to claim 1 wherein said means for providing a supply of fuel under regulated superatmospheric pressure comprises deflectable tubular means, wherein said tubular means comprises conduit means, and wherein said fuel discharge orifice means comprises an open end of said conduit means.

5. Fuel injection apparatus according to claim 4 wherein said means responsive to indicia of engine operation comprises magnetic field generating means, and wherein said magnetic field generating means is effective to deflect said tubular means in order to determine whether said fuel discharged by said discharge orifice means is directed to either of said first or second inlet means.

6. Fuel injection apparatus and system for a combustion engine, comprising throttle body means, induction passage means formed through said throttle body means, throttle valve means for controlling the flow of induction air through said induction passage means, an associated source of fuel, metered fuel discharge nozzle means for discharging metered fuel into said flow of induction air through said induction passage means, said metered fuel discharge nozzle means comprising first fuel inlet means, fuel return passage means for operative communication with said associated source of fuel, said fuel return passage means comprising second fuel inlet means, fuel discharge orifice means, means for providing a supply of fuel under regulated superatmospheric pressure to said fuel discharge orifice means as to be discharged therethrough, and means responsive to indicia of engine operation for causing a first portion of said fuel as is discharged from said discharge orifice means to flow into said second inlet means and through said fuel return passage means and causing a second portion of said fuel as is discharged from said discharge orifice means to flow into said first inlet means and to be discharged by said metered fuel discharge nozzle means into said flow of induction air, said second portion of said fuel as is discharged into said flow of induction air determining the rate of metered fuel flow being supplied to said engine, said means responsive to indicia of engine operation being effective to vary the relative proportion of said first portion compared to said second portion as to thereby vary the rate of said metered fuel flow in accordance with engine operating conditions, wherein said means for providing a supply of fuel under regulated superatmospheric pressure comprises deflectable tubular means, wherein said tubular means comprises conduit means, wherin said fuel discharge orifice means comprises an open end of said conduit means, wherein said tubular means is supported in a cantilevered manner as to have said discharge orifice means movable relative to said first and second inlet means, wherein said means responsive to indicia of engine operation comprises magnetic field generating means, and wherein said magnetic field generating means is effective to cause deflection of said tubular means in order to thereby determine whether said fuel discharged by said discharge orifice means is directed to either said first or second inlet means.

7. Fuel injection apparatus according to claim 6 wherein said tubular means has an inherent spring rate, wherein said magnetic field generating means comprises a field winding and associated pole-piece means, and armature means operatively connected to said tubular means and effective to be magnetically attracted toward said pole-piece means upon energization of said field winding.

8. Fuel injection apparatus according to claim 7 wherein said fuel discharge orifice means is effective for discharging fuel therefrom and toward said first inlet means when said armature means is attracted to said pole-piece means.

9. Fuel injection apparatus according to claim 6 and further comprising spring means for supporting at least a portion of said tubular means, wherein said magnetic field generating means comprises a field winding and associated pole-piece means, wherein said spring means is effective to be magnetically attracted toward said pole-piece means upon energization of said field winding, and wherein said tubular means moves with said spring means when said spring means is attracted to said pole-piece means.

10. Fuel injection apparatus according to claim 9 wherein said spring means is supported in a manner as to be cantilevered, and wherein when said cantilevered spring means is attracted to said pole-piece means said spring means and said tubular means are angularly deflected.

11. Fuel injection apparatus according to claim 10 wherein said tubular means is comprised of flexible material.

12. Fuel injection apparatus according to claim 6 wherein said magnetic field generating means comprises an annular field winding defining a generally medially situated axially extending clearance passageway therethrough, wherein said tubular means extends at least partly through said clearance passageway, and wherein said tubular means when in a null position is situated as to be eccentrically disposed with respect to the axis of said clearance passageway.

13. Fuel injection apparatus according to claim 6 wherein said magnetic field generating means comprises field winding means having at least portions disposed at generally opposite sides of said tubular means, wherein said tubular means is deflected as a consequence of moving to a position whereat the spring force of said tubular means is balanced by the magnetic force of the magnetic field generated by said magnetic field generating means when said field winding means is energized.

14. Fuel injection apparatus according to claim 6 wherein said fuel return passage means extends transversely of and through said induction passage means.

* * * * *